US006135622A

United States Patent [19]

Downing

[11] Patent Number: 6,135,622

[45] Date of Patent: Oct. 24, 2000

[54] CHANGEABLE VISUAL DISPLAY LAMP

[76] Inventor: George M. Downing, 218 E. Osage, Rose Hill, Kans. 67133

[21] Appl. No.: 09/116,059

[22] Filed: Jul. 15, 1998

[51] Int. Cl.[7] ..... F21S 1/10

[52] U.S. Cl. ..... 362/410; 362/411; 362/412; 362/413; 362/430; 40/553

[58] Field of Search ..... 362/410, 411, 362/412, 413, 414, 409, 431, 430; 40/553, 554, 558

[56] References Cited

U.S. PATENT DOCUMENTS

| | | | |
|---|---|---|---|
| 5,217,298 | 6/1993 | Jackson et al. | 362/226 |
| 5,523,934 | 6/1996 | Dworman et al. | 362/431 |
| 5,598,652 | 2/1997 | Nurre | 40/553 |

*Primary Examiner*—Cassandra Spyrou
*Assistant Examiner*—Mohammad Sikder
*Attorney, Agent, or Firm*—Bradley P. Sylvester

[57] ABSTRACT

An improved changeable visual display lamp, having the ability to accept single piece cylinder sheets of artwork, or other items for display, where the cylinder is able to be inserted into the confines of an annular tubing through the removal of a single piece of the lamp. The two variations of this lamp allow cylindrical items to either be inserted through the bottom of the lamp by the removal of a single plate, or through the top of the lamp, through the removal of a single ring, where the ring covers a circular gap that extends around a centrally located socket. No tools are necessary to change the item or items being displayed, the person changing the display is not exposed to electrical shock, and the time required to change the display is reduced to a nimum. Benefits of the ring are seen where the ring may be removed, and single piece cylinder artwork is removed or inserted, without even unplugging or disassembling the lamp, other than manipulation of the single ring.

4 Claims, 3 Drawing Sheets

10
19
71
31
80
62
26
70
61
60
19
20
71
26
10

80
62
80
31
33

45
11
26
9
9
45
33
26

19
20
26

CHANGEABLE VISUAL DISPLAY LAMP

BACKGROUND OF THE INVENTION

This invention comprises an improved lamp capable of supporting and displaying artwork, where the artwork comprises a sheet of flexible material that has been formed into a cylindrical length of tubing. In addition, this invention allows other items such as marbles, golf tees, or any other type of three dimensional items desired for display. Previously, lamps that were intended to accept artwork, required that the artwork be comprised of a sheet of flexible material which was bent or curved so as to fit within a container intended to hold the artwork. With prior art lamps, the artwork was required to be a sheet of flexible material, rather than an actual length of cylindrical tubing, where the ends of the sheet were fixed together to form a cylinder, since there was no means to allow the single cylindrical piece of artwork to be placed into the lamp.

Previous problems generally involved the electrical cord and the socket assembly, in which one or both needed to be inserted through the cylinder defined by the artwork. Using a sheet of flexible material, where the ends were notjoined together to form a cylinder, often allowed a gap to be defined along the length of the cylinder as defined by the terminating ends of the flexible sheet.

The gap was necessary to allow the cord to slip inside the curved cylindrical support of said artwork. Generally, since any unattached ends of the artwork were able to move apart from each other, this allowed the ends of the flexible material to move independently of each other, and the artwork quality was usually diminished. This was caused by portions of the artwork that did not match up from one end of the material to the other, due to the irregular pattern continuation between one portion of the artwork and the other, as well as the overlapping portions of the artwork visible so that it was evident that the artwork remained a formed sheet of material, rather than a formed uniform cylinder or other object. Prior art inventions have failed to address the problem of having a lamp accept a sheet of artwork, in which the ends of said sheet have been attached to each other to form a single cylinder of artwork.

Referring now to U.S. Pat. No. 4,028,848 (Murray), a prior art lamp is shown, in which the lamp has the ability to contain a desired display within the confines of the supporting structure of the lamp. In this particular patent, the lamp can contain a terrarium. The matter being displayed can be introduced into the lamp's supporting structure, or pedestal portion, by separating the upper and lower portions of said pedestal. This particular lamp attempts to deal with the problem of the socket and electrical supply, by having the electrical cord literally unplug within the pedestal portion. The obstruction caused by the socket is eliminated by simply removing the socket. This particular lamp does not address or give rise to any artistic inference that would allow the socket to remain in place, along with the cord remaining intact, where the artwork would still be able to be inserted or removed.

Referring now to U.S. Pat. No. 4,504,893 (Bostick), a prior art lamp is shown, in which the pedestal portion has a top cap that can be removed, so as to allow access to the interior portion of the pedestal. The obstruction that would normally be caused by a socket is removed, since the sockets are not placed directly above the pedestal, but are instead situated to one side. The benefits of this lamp are unable to be realized if a socket is positioned directly above the pedestal portion of the invention. In addition, this lamp is unable to accept artwork in a single cylinder form, where the socket is directly above the pedestal poriton.

Referring now to U.S. Pat. No. 5,473,525 (Stout), a display lamp is shown, in which the invention contemplates the possibility of a terrarium in the lamp, and a desire for easy access to the lamps interior. Access to this lamp is not readily obtained through the top portion of the pedestal, and so there is no attempt, actual or inferred, to deal with the problem of obstruction by the socket by attempting to insert items through the top side of the lamp.

Referring now to U.S. Pat. No. 5,598,652 (Nurre), a lamp having a changeable display base is shown. This lamp has some similarities with the present invention, but evidences the shortcomings that this present invention overcomes. In this lamp, the display sleeve must define a longitudinal gap, so that the electrical cord can pass through the gap, whereby the electrical cord is effectively surrounded by the visual display sleeve. Without the gap, the display sleeve is unable to be fitted within the lamp. This lamp is unable to display a tubular section of a display in which no longitudinal gaps are defined. Any artwork used with this lamp, where the artwork is comprised of a sheet, most not have its ends joined together in any permanent nature, prior to its introduction into the lamp. This shortcoming is avoided in the present invention.

While lamps can be created at the initial manufacturer's point of construction so as to be infused any desired artwork into a specific lamp, the ideas and priorities of people tend to change over time, which also causes artwork within a lamp to either become outdated or uninteresting. Removal of the artwork should involve minimal effort, as well as the replacement of the artwork likewise involving minimal effort.

SUMMARY OF THE INVENTION

This invention relates particularly to a lamp, in which a means has been provided to allow the insertion of an individual or desired piece of artwork, where the artwork is able to comprise a single piece cylinder, which is able to be inserted into the lamp. The lamp is structured so that the artwork can be removed and replaced with a new or additional artwork, with minimal time and barriers involved in the removal and/or insertion of new artwork.

The lamp itself is comprised of a base which supports an annular tubing, where said annular tubing used is sufficiently optically clear so that an item placed within the annular tubing is able to be viewed from outside the tube. It is not necessary that the annular tubing than any specific shape, other than that which is desired by the user. For example, the annular tubing may be formed of the series of flat edges, so that instead of section of tubing, a section of an octagon or a hexagon shaped cylinder is used. The artwork to be inserted into the annular tubing may comprise a single piece cylinder formed from a sheet of flexible material, or the artwork may comprise a thick walled rigid piece of artwork, which conforms or is able to closely match the interior of the annular tubing. Where a sheet of artwork is used, a supporting rigid cylinder may be inserted, so as to press the artwork against the annular cylinder walls.

The base supports a shaft which protects and guides the electrical cord from the base to the light socket, which is located at the end of the shaft. The light socket may also have an ornamental top cover, which is placed immediately below the light socket. Preferably, the shaft is able to be rigidly attached to the base, so that the light socket and any top cover used will stand independently of the rest of the lamp. Where the socket may support the shade wire supports, such wire supports are generally easily removed from the socket in virtually every type of lamp that utilizes such shade wire supports.

That annular tubing may have any thickness as desired, and as stated above, may comprise any one of a variety of shapes. Where the annular tubing is fixed to the base, using a permanent means, the diameter of the inner space defined by the annular tubing should still be sufficient so that it is greater than the diameter of the socket and any top cover.

Since the diameter of the inner space defined by the annular tubing is greater than the socket and any top cover being used, a gap should exist between the circumferential edges of top cover and the end or top rim of the annular tubing.

A piece of artwork is able to be inserted into that annular tubing, where the artwork comprises the tubular portion that has the defining inner diameter which exceeds that of the socket and any top cover, but where the outer diameter of the artwork is less than the diameter of the inner space defined by the annular tubing. This will allow the artwork to be slid down past the socket and any top cover into the annular tubing, where the artwork passes through the gap defined by the space between the circumferential edge of the top cover and the top rim of the annular tubing. The length of the artwork being placed into that annular tubing, should not exceed the height of the annular tubing, so that the entire artwork is able to be contained within said annular tubing.

Where the bottom rim of the annular tubing rests on a display plate, the artwork will be supported and prevented from further downward movement by the display plate. The display plate should have a diameter which at least equals or exceeds the outer diameter of the annular tubing as defined by the bottom rim. Where the annular tubing is supported directly by the base, the artwork will rest directly on the top side of said base, and a groove may be used, to fix the annular tubing into position on said base.

Once the artwork is completely inside the annular tubing, it may be adjusted as needed, and then the gap between the top cover and annular tubing is closed using a cover ring. A rigid cylinder sleeve may be used, where the rigid cylinder sleeve is able to be located within the space defined by the display tubing, so that the display portion can be pressed into the proper configuration.

The cover ring is able to the removed completely from the rest of the lamp, when artwork is being inserted or removed, so as to allow unrestricted access to the gap between the top cover and annular tubing. Once the annular ring is placed back onto the lamp, preferably its inner mouth will contact the top cover, which has sides which slope outward slightly, so that the circumference of the top cover increases towards its bottom edge. The cover ring mouth, preferably has a circumference which exceeds a portion of the top cover's circumference, but yet is less than the circumference of the top cover along its bottom edge route. In this manner, there will be no gap between the cover ring and the top cover. Preferably, the shape of the cover ring,. comprising the outer most edge, will be formed so that it rests on top of the annular tubing, with the lip covering the top rim of the annular tubing slightly.

An alternate method to inserting and removing artwork, is to provide an annular tubing length with a base, and a fixed top cover supporting the socket. The cord for supplying electrical power to the socket will extend through the length of the annular tubing and our through the bottom base. The bottom base is provided with a bottom cover, comprising a ring or solid plate. The ring or solid plate has a service area which defines the circumference less than the inner circumference of the annular tubing.

This particular lamp allows artwork to be inserted through the bottom, rather than the top. When the bottom base plate is removed, the interior of the annular tubing is accessible. A length of tubing of artwork is able to be inserted into this lamp by guiding the electrical cord, plug first, through the length of the artwork cylinder. The artwork cylinder is then thrust into the annular tubing, and once inside, the ring or bottom plate is replaced.

Accordingly, it is therefore on object of this invention to provide a lamp having the capability to display artwork, where the artwork can comprise a single piece cylinder formed from a sheet of flexible material, where the ends of said sheet are permanently joined to create the cylinder, where said artwork can be removed and replaced without having to cut the artwork or define any longitudinal gaps.

It is a further object of this invention to provide a lamp, in which the artwork is able to be inserted or removed while the lamp remains in an upright position.

It is a further object of this invention to provide a lamp in which the art work is able to be inserted or removed through the bottom side of the lamp.

DESCRIPTION OF THE PREFERRED EMBODIMENT

Figure 6:
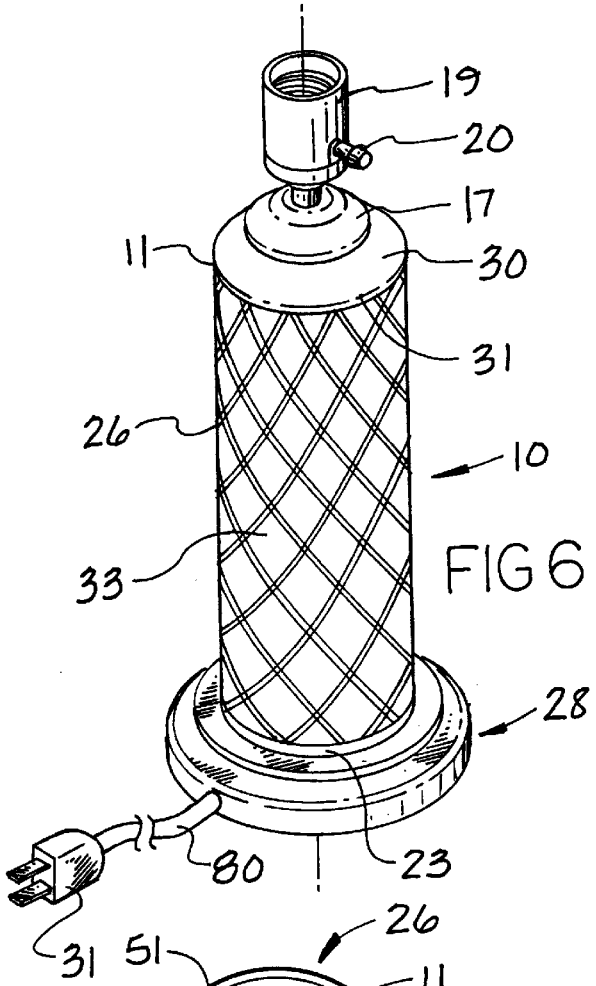
FIG. 6 is a perspective view of lamp, in which an artwork has been placed therein, and where the cover has been placed over the top of the annular tubing, showing a lamp that is ready for use.
Figure 1:
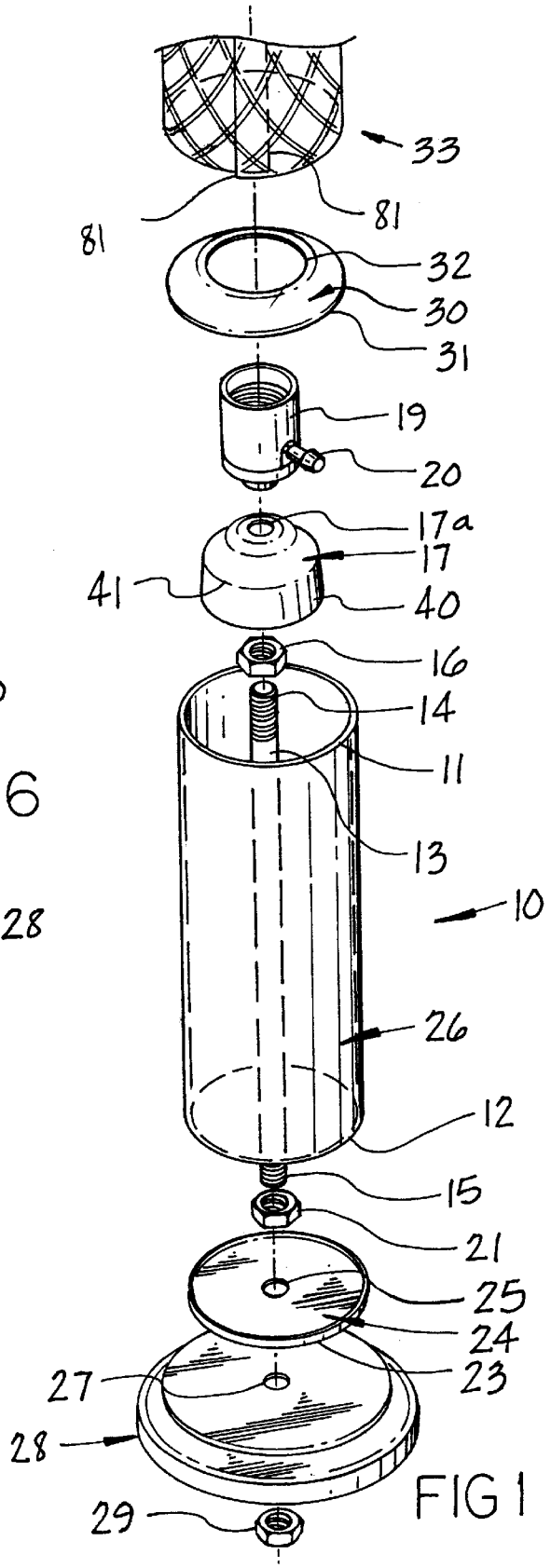
FIG. 1 depicts a perspective and exploded view of the lamp, with the artwork shown in position above the lamp.

Referring now to FIG. 1 and FIG. 6, the improved display lamp 10 is shown. A base 28 is provided, which serves as a means to support a rigid shaft 13 which supports a socket 19. The rigid shaft 13 has a top threaded end 14 and a bottom threaded end 15, which allows the rigid shaft 13 to be fixed to both the base 28 and the socket 19.

The bottom threaded end 15 of the shaft 13 may be fixed to the base 28 using any means commonly known in the art. It is preferable, however, for a top base nut 21 to be screwed on to the bottom threaded end 15, so that a portion of the bottom threaded end 15 protrudes downward below the top base nut 21. This protruding threaded end 15 is able to be inserted through a base shaft hole 27, which is defined by the base 28, with the base shaft hole 27 generally located in the central portion of the top side of base 28. Once the protruding threaded end 15 has been inserted through the base shaft hole 27, a bottom base nut 29 can be fitted onto said threaded end 15 and tightened so that any portion of the base 28 between the top base nut 21 and bottom base nut 29 is gripped or squeezed between said nuts 21 and 29.

The top threaded end 14 of shaft 13 is attached to the socket 19 therein, by inserting the top threaded end 14 through a top shaft nut 16, which provides a platform onto which the top cover 17 may be placed upon. The top shaft nut 16 preferably has a length of the top threaded end 14 of shaft 13 protruding upward from nut 16, so that the top cover 17, which defines a top cover hole 17*a*, can be placed upon the shaft 13, by inserting the top threaded in 14 through hole 17*a*, and screwing said threaded end 14 directly into socket 19. When tightened, socket 19 will press the top cover 17 against nut 16.

The shaft 13 provides a means to direct an electrical cord 80 from the base 28 to the socket 19. When the shaft 13 is rigidly fixed to base 28, the socket 19 should be supported and fixed in position, where the top cover 17 is positioned above base 28, so that a length of annular tubing 26 can be placed on the base 28, without the top rim 11 of said annular tubing 26 having a height that extends above the top cover 17.

Figure 2:
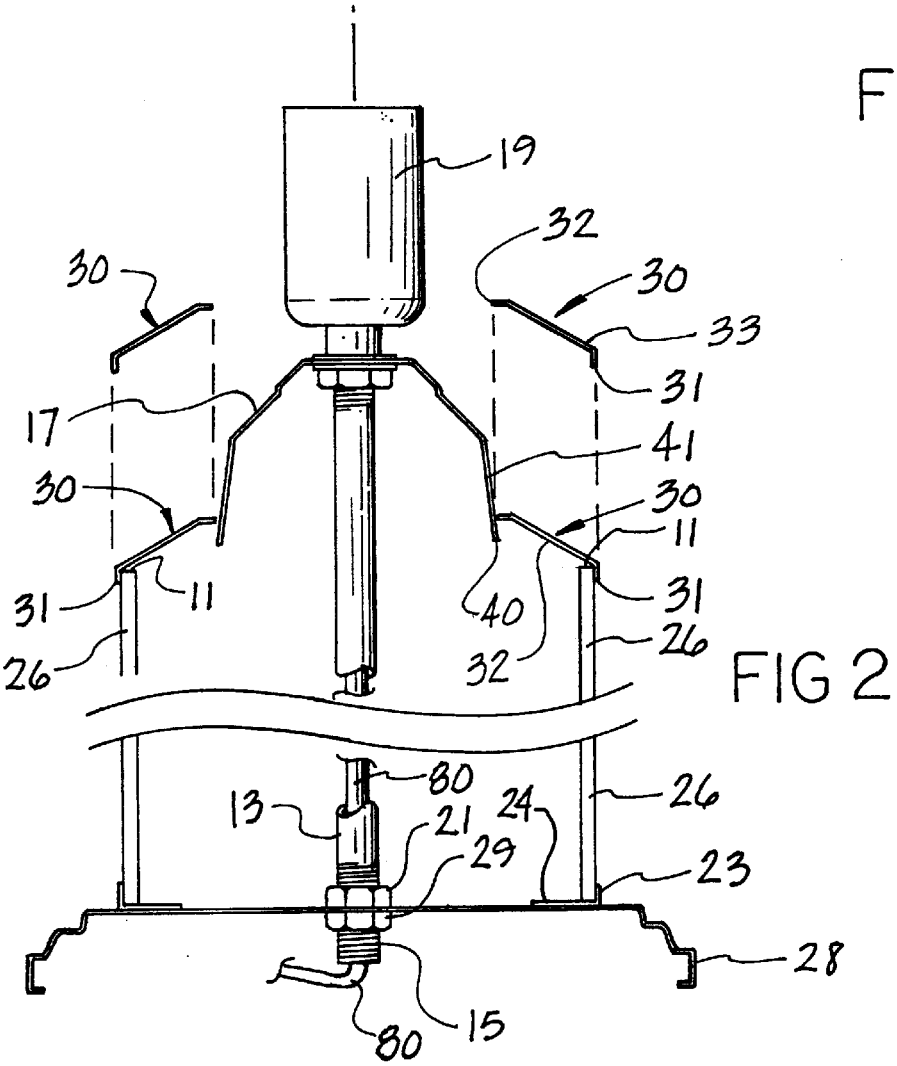
FIG. 2 depicts a cross-sectional view of the lamp showing the cover as it is positioned on the lamp, and also shown removed from lamp.

Referring also to FIG. 2, the top cover 17 is generally bowl shaped, and has an increasing circumferential measurement that is greater the farther the distance from hole 17*a*. The top cover 17 preferably has fluted sides 41 which terminate in a lip 40. The circumference of lip 40 is preferably greater than any other circumferential measurement that is able to be applied to the top cover 17. As it is shown in FIG. 2, top of sides 41 define a circumference that is slightly less than the circumference of the bottom of sides 41, which is defined as the lip 40. This is due to the outward angle, or fluting of sides 41.

Referring to FIG. 1 and FIG. 2, the cover ring 30 is defined by an inner mouth edge 32 and the outer cover lip 31. The circumference of the inner mouth edge 32 is preferably less than the circumference as defined by lip 40 of the top cover 17, but greater than at least a portion of the circumference defined by the top cover 17. As is shown in FIG. 2, the circumference defined by the mouth edge 32 of the cover ring 30, should be almost equal to, without exceeding, the circumference defined by lip 40. This will allow the cover ring 30 to be placed over the top cover 17, with the cover ring 30 being restricted as to downward movement past the top cover 17, due to the greater circumference of the top cover 17, than the mouth edge 32 of cover ring 30.

It should not be construed as a requirement that the top cover 17 actually restrict the movement of the cover ring 30 past it. It is only necessary for this invention that the cover ring 30 be able to surround the top cover 17, with the lip 31 of the cover ring 30 defining a circumference greater than any part of the top cover 17.

Figure 5:
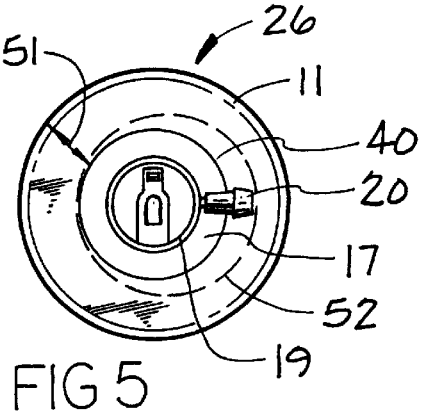
FIG. 5 is a top view of the lamp, showing the socket centrally positioned over a section of annular tubing, indicating a minimum circumference necessary for artwork to be placed over the socket and top cover.

The mouth edge 32 of the cover ring 30 defines a space which should have a sufficient area and shape that allows the cover ring 30 to move upward or downward past the socket 19 and its switch 20. Referring also to FIG. 5, a minimum necessary circumference 52 is shown, as indicated by the dashed circular line 52, which indicates the minimum circumference necessary for an object to move past the socket 19 and switch 20, so that the socket 19 and switch 28 can be inserted through said cover ring 30. As shown in FIG. 5, a minimum circular circumference 52 is shown, but the cover ring 30 may define a space by its mouth edge 32, having any necessary shape that would allow the cover ring 30 to have the socket 19 and switch 20 inserted through it. This could comprise, for example, a key hole shaped area that would conform with, but be slightly greater than the cross-sectional shape of the socket 19 and switch 20.

An annular tubing 26 is provided, where said annular tubing 26 is comprised of a length of the clear or translucent material that has been formed into a length of tubing that defines an inner circumference greater than the circumference of the top cover 17. This annular tubing 26 is placed on the base 28, with the shaft 13 longitudinally positioned within the space defined within said annular tubing 26. A means to hold said annular tubing 26 in position on the base 28 is provided, so that the shaft 13 extends upward through the interior space defined by the annular tubing 26.

Any means may be used to hold said annular tubing 26 in position on base 28, commonly known in the art. The means to hold said annular tubing 26, specifically shown in FIGS. 1 through 11 is preferably comprised of a display plate 24, or a groove 35, both of which will be more fully discussed below.

The display plate 24 is a flat rigid disk, defining a display plate shaft hole 25, through which the shaft 13 is able to protrude through. The display plate 24 is defined by a plate edge 23, being a rim that protrudes upward slightly. The defining circumference of the plate edge 23 is slightly greater than the outer edge circumference of the annular tubing 26. Thus, when the annular tubing 26 is placed down onto the display plate 24, the outer edge defined by the bottom rim 12 is able to be fitted inside the circumference of the display plate edge 23, so that the bottom rim 12 rests directly against the top side of the display played 24, with the plate edge 23 surrounding the bottom rim 12 and a partial amount of the length of the annular tubing 26, so that the annular tubing 26 is restricted as to any lateral movement while on the base 28.

The displaying plate 24 is held against base 28, using a nut 21 which has been tightened onto the bottom threaded end 15 of shaft 13, and where the display plate 24 is positioned between net 21 and nut 29, so that when said nuts 21 and 29 are urged together, they will grip the base 28 and display plate 24 between them, so that the shaft 13, display plate 24, base 28, and top cover 41 are all rigidly positioned in relationship to each other.

Figures 7, 8, 9, 10, 11:
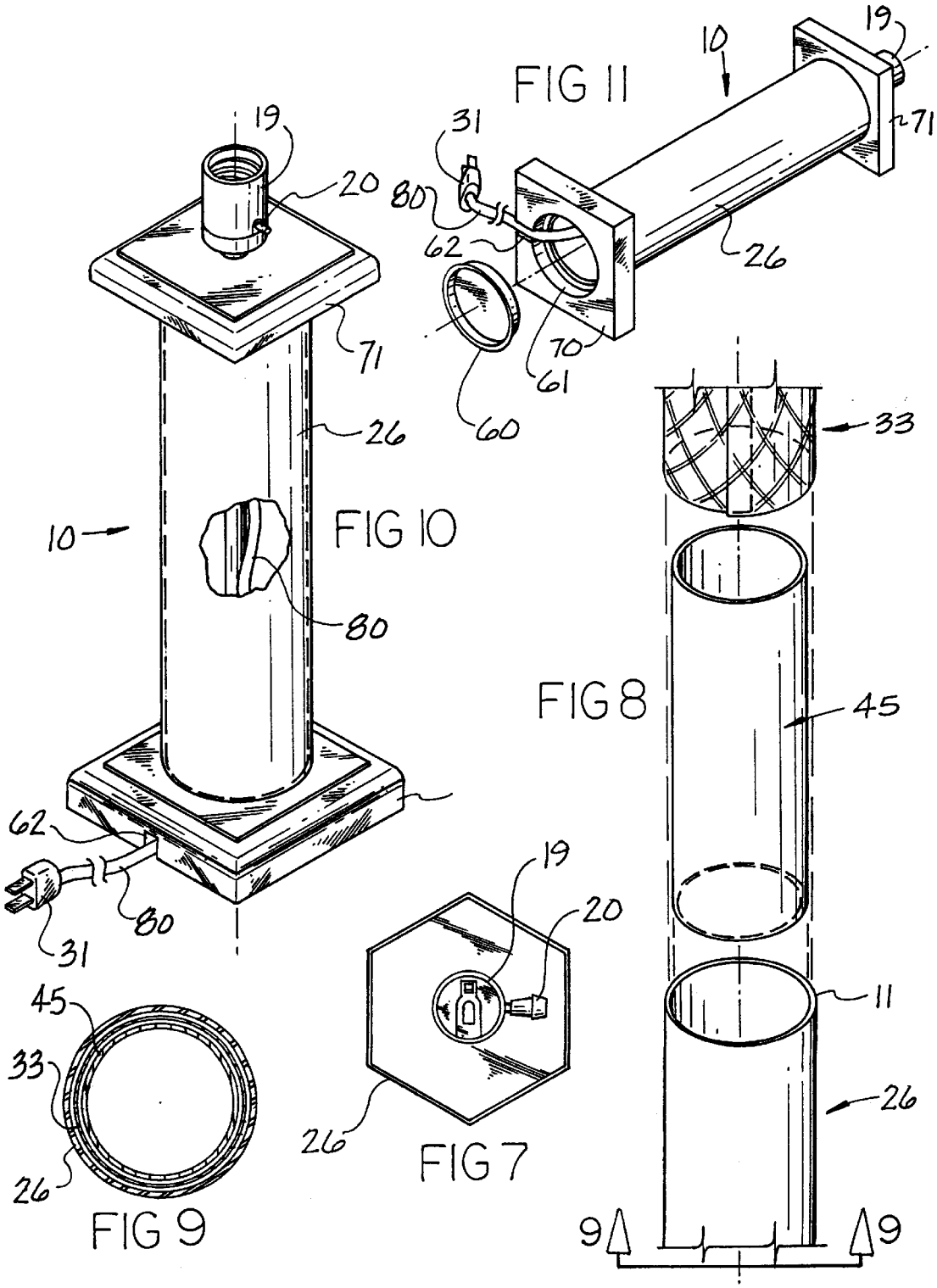
FIG. 7 is a top view of the top rim of an annular tubing, which defines a hexagon cross sectional structure with its outer walls.
FIG. 8 is an exploded perspective view of the annular tubing, with a cylinder of artwork ready to be placed around a cardboard tube, with the cardboard tube and artwork then being placed within the annular tubing.
FIG. 9 is a cross sectional view of FIG. 8, showing the artwork placed between a cardboard tube and the annular tubing, so that the cardboard tube is able to press the artwork against the inner side of the annular tubing.
FIG. 10 is a perspective view, from the upper side of a lamp, where the removal and/or insertion of the artwork is done through the base.
FIG. 11 is a perspective view, from the bottom and side of a lamp, where the removal and/or insertion of the artwork is done through the base, showing their retaining ring removed from the base.

The annular tubing 26, although depicted as a smooth round section of tubing, may be of any desired shape that is desired. The shape of the annular tubing 26, as defined by the bottom rim 12 should mirror and match the shape of the plate edge 23. For example, if the annular tubing 26, as shown in FIG. 7 has a hexagon crosssectional structure, a display plate 24 would also need to define a hexagon shaped plate edge 23, where the circumference of the plate edge 23 would be slightly greater than the circumference of the hexagon shaped annular tubing 26.

Figure 4:
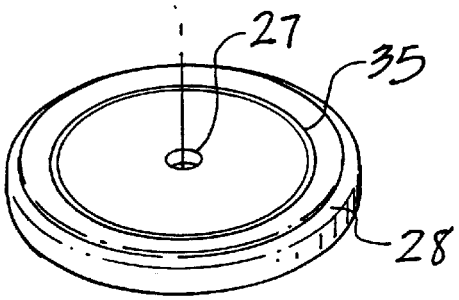
FIG. 4 is a perspective view of the base, showing the groove as defined by the base to receive the annular tubing.
Figure 3:
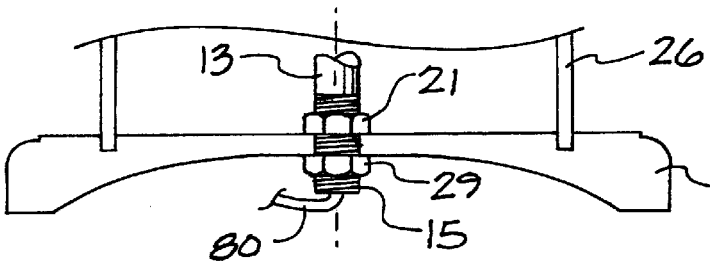
FIG. 3 is a cross-sectional view of the base, in which the annular tubing is fixed to the base through the placement of the bottom rim of the annular tubing into a groove defined by base.

Referring also to FIG. 3 and FIG. 4, a second means to hold the annular cylinder 26 in position on a base 28 is shown. A groove 35 is defined on the top side of said base 28. The groove 35 comprises a recessed area having a width that equals or exceeds the thickness of the annular tubing 26 used with the lamp 10. The groove 35 functions in the same manner as the display plate 24, in that when the bottom rim 12 of the annular tubing 26 is placed into groove 35, a small portion of the length of the annular tubing 26, along with the bottom rim 12 reside within the confines of the groove 35. The walls of said groove 35 restricting movement of the annular tubing 26, with regard to any lateral movement across the base 28. It may be desirable to have the bottom rim 12 of the annular tubing 26 fixed within the confines of groove 35, using an adhesive, or through the gripping of the annular tubing 26 by the side walls of groove 35, in which the tolerance between the gap defined by said groove 35 and the width of the annular tubing 26 are virtually identical.

Groove 35 must be defined so that it matches the configuration of the bottom rim 12. As shown in FIG. 4, groove 35 is intended to receive an annular tubing 26 having the configuration as shown in FIG. 1, where the annular tubing has a circular bottom rim 12. Where the annular tubing 26 has a configuration other than that shown in FIG. 1, such as is shown in FIG. 7, being a hexagon shaped annular tubing 26, the groove 35 would by necessity be defined as a hexagon shaped depression where the gap of the groove 35 would match across section of the bottom rim 12 of the annular tubing 26.

When the shaft 13 is fixed to base 28, so that the top cover 17 and socket 19 are rigidly held in position, the annular tubing 26 may be placed over the socket 19, top cover 17 and shaft 13, so that the bottom rim 12 is resting on the display plate 24, or where grooves 35 are used, the bottom rim 12 of the annular tubing 26 is positioned within groove 35. Once the annular tubing 26 is properly positioned, the shaft 13 extends through the annular tubing 26 and projects above the top rim 11, so that the top cover 17 and socket 19 are both above the top rim 11, as is shown in FIG. 2 and FIG. 6.

A gap is defined between the lip 40 of the top cover 17 and the top rim 11 of the annular tubing 26. This gap should extend completely around the lip 40 of the top cover 17. Referring to FIG. 5, the gap is designated by space 51, which is defined as the distance between the inner wall surface of the annular tubing 26 and the sides 41 of the top cover 17. This gap should be defined as a continuous unobstructed space that surrounds the top cover 17. As is shown in FIG. 5, the switch 20 may extend into the area defined by the gap 51, which is not uncommon where the switch 20 comprises a lateral projection from the socket 19. When using a circular area, to define the minimum circumference necessary that an item must possess to move past the top cover 17, socket 19 and switch 20, said minimum circumference would be defined as shown by circumference line 52. Any additional tubes that are inserted into the annular tubing 26, must have an inner circumference that equals or is greater than that shown by circumference line 52.

Any type of artwork 53 may be inserted into the confines of the annular tubing 26. The artwork 33 may be comprised of a sheet of flexible material that has been formed into a cylinder as it is shown in FIG. 1, with either overlapping ends 60 and 61 or where ends and 60 and 61 have been currently joined together to form a tube shaped cylinder. As stated above, the artwork 33 need not defined a gap between its ends 60 and 61, provided that the inner circumference of the artwork equals or exceeds the circumferential line 52 as shown in FIG. 5.

The cylindrical artwork 33 should have an outer circumference that is less than the inner circumference of the space defined by the inner walls of the annular tubing 26. Said cylindrical artwork 33 may be placed into the confines of the annular tubing 26, by simply removing the cover ring 30, to expose gap 51 as shown in FIG. 5, and sliding the artwork 33 passed the socket 19, switch 20 and top cover 17, directly into the annular tubing 26. The length of the artwork 33 should not exceed that of the annular tubing 26, so that the artwork 33 is able to be contained completely within that annular tubing 26, once the cover ring 30 is returned to its original place, covering the gap 51, with the cover ring 30 re-positioned as shown in FIG. 6, and also shown as a cross sectional view in FIG. 2.

Referring now to FIGS. 8 and 9, the annular tubing 26 is shown, with the artwork 33 positioned so that it may be inserted into the confines of the annular tubing. Since various artworks 33 may be comprised of paper or thin sheets of material that are subject to wrinkling and/or non-conformity with the inner surface of the annular tubing 26, it is generally necessary to provide the means to keep the artwork 33 positioned against the inner surface of the annular tubing 26. FIG. 8 depicts a rigid cylinder 45 which has an outer circumference less than any inner circumference of the artwork 33. The rigid cylinder 45 is typically comprised of cardboard or any other rigid material such as a plastic composition. The rigid cylinder 45 preferably has an inner circumference greater than the minimum circumference 52 as shown in FIG. 5. In this manner, the rigid cylinder 45 may be removed along with any artwork 33 from the lamp 10 as desired. When the rigid cylinder 45, artwork 33 and annular tubing 26 are placed together, the artwork 33 is positioned between a gap defined as the space between the outer surface of the rigid cylinder 45, and the inner surface of the annular tubing 26, as shown in FIG. 9.

A further option that is usable to insert artwork into a lamp 10 having a annular tubing 26, is shown in FIG. 10 FIG. 11. In this particular lamp 10, the rigid shaft 13, as shown in FIG. 1,2 and 3 is omitted. The socket 19 is supported by a top base 71 which is attached directly to the top rim 11 of annular tubing 26A. The bottom rim 12 of the annular tubing 26 is attached directly to a bottom base 28, preferably using a groove 35, as shown in FIG. 4, so as to fix the annular tubing 26 in relation to the bottom base 70. An electric cord 30, having a terminating end comprised of a plug 31 extends through the bottom base 70, through the interior of the annular tubing 26, to socket 19 which is positioned on top base 71, with a hole defined (not shown) which allows the electric cord 30 to directly in each socket 19.

The same artwork 33 described above may be inserted into the lamp 10, as depicted in FIG. 10 and FIG. 11, by a removing a bottom end cap 60, which serves to effectively plug the bottom area of the annular tubing 26, as defined by the bottom rim 12. The bottom end cap 60 fits into plug hole 61, so that when the bottom end cap 60 is situated in plug hole 61, any artwork and contents located within annular tubing 26 are prevented from falling out through the plug hole 61.

The electric cord 80 is directed into the confines of the annular tubing 26, through a notch 62 which allows the electric cord 80 to enter into the plug hole 61, with the notch 62 allowing that electric cord 30 to be completely recessed within the walls of plug hole 61, so that the bottom end cap 60 is still able to be placed into plug hole 61, without any gap being created by the presence of the electric cord 80 between the bottom base in 70 and bottom end cap 60. As a shown in FIG. 8 and FIG. 9, the artwork 33 may be held against the interior wall of the annular tubing 26, through insertion of the rigid cylinder 45. The ends 81 and 81 of artwork 33 may be currently fixed together so that no gap is defined between ends 81 and 81. To insert the artwork 33 and rigid cylinder 45 into annular tubing 26 for the lamp 10 as shown in FIG. 10 and FIG. 11, the electric cord 80 is directed through the artwork 33 and any rigid cylinder 45 that is used, so that plug 31 is drawn through the length of both artwork 33 and any rigid cylinder 45, with the electric cord 30 removed from notch 62, so that the entire electric cord 80 length is able to pass through the artwork 33 and rigid cylinder 45. Once the artwork 33 and any rigid cylinder 45 are inserted into the annular tubing 26, both the artwork 33 and rigid cylinder 45 should have moved into the annular tubing 26 so that they no longer protrude into the area defined by the plug hole 61. The electric cord 80 is returned to the confines of notch 62, and the bottom end 60 is pressed laterally into the plug hole 61, which effectively blocks the plug hole, and prevents any artwork 33 or rigid cylinder 45 from moving back out through the plug hole 61.

From the foregoing statements, summary and description in accordance with the present invention, it is understood that the same are not limited thereto, but are susceptible to various changes and modifications as known to those skilled in the art and we therefore do not wish to be limited to the details shown and described herein, but intend to cover all such changes and modifications which would be encompassed by the scope of the appended claims.

I claim:

1. An improved changeable visual display lamp, into which a sheet of material that has been formed into a cylinder is inserted, comprising:

a. a bottom base;

b. a length of annular tubing, having means to fix said annular tubing to said base;

c. a light socket, supported by a top base;

d. an electrical cord, situated within the annular tubing, extending out of both ends of the annular tubing, and attached to the light socket; and wherein the bottom base defines a plug hole, in which a bottom end cap is positioned, so that when the bottom end cap is removed, the plug hole define an opening of similar size as the bottom of the annular tubing, and means to fix the annular tubing to the bottom base comprises a circular groove with a recessed area having a width that equals to a thickness of said annular tubing, defined by top side of the bottom base, into which a bottom rim of the annular tubing is placed.

2. An improved changeable visual display lamp, into which a sheet of material that has been formed into a cylinder is inserted, as recited in claim one, in which the annular tubing is positioned within the recessed area of the groove, said circular groove accepts the thickness of said annular tubing.

3. An improved changeable visual display lamp, into which a sheet of material that has been formed into a cylinder is inserted, as recited in claim one, in which the top base is directly attached to a top rim of the annular tubing.

4. An improved changeable visual display lamp, into which a sheet of material that has been formed into a cylinder is inserted, as recited in claim one, where the electrical cord enters through said plug hole and travels through the annular tubing to the socket.

* * * * *